United States Patent [19]

Speil et al.

[11] Patent Number: 4,876,994

[45] Date of Patent: Oct. 31, 1989

[54] HYDRAULIC PLAY COMPENSATION ELEMENT

[75] Inventors: Walter Speil, Ingolstadt; Bolko Schuseil, Erlangen; Dieter Schmidt, Nuremberg, all of Fed. Rep. of Germany

[73] Assignee: INA Walzlager Schaeffler KG, Fed. Rep. of Germany

[21] Appl. No.: 337,952

[22] Filed: Apr. 14, 1989

[30] Foreign Application Priority Data

Apr. 30, 1988 [DE] Fed. Rep. of Germany ..... 3814700

[51] Int. Cl.[4] ..... D01L 1/24; F15B 15/08

[52] U.S. Cl. ..... 123/90.5; 123/90.55

[58] Field of Search ..... 123/90.5, 90.55, 90.56, 123/90, 57, 90.59

[56] References Cited

U.S. PATENT DOCUMENTS

| | | | |
|---|---|---|---|
| 2,688,319 | 9/1954 | Humphreys | 123/90.55 |
| 4,437,439 | 3/1984 | Speil | 123/90.55 |
| 4,584,976 | 4/1986 | Hillebrand | 123/90.55 |
| 4,607,599 | 8/1986 | Buente et al. | 123/90.5 |
| 4,747,376 | 5/1988 | Speil et al. | 123/90.55 |
| 4,771,741 | 9/1988 | Leer | 123/90.5 |

*Primary Examiner*—Willis R. Wolfe
*Assistant Examiner*—Weilun Lo
*Attorney, Agent, or Firm*—Bierman & Muserlian

[57] ABSTRACT

A hydraulic play compensation element for the drive of a valve of an internal combustion engine with a housing in which a hollow piston is mounted such as to be acted upon, via a non-return valve, by oil pressure, the hollow piston being surrounded by an oil reservoir which communicates via an oil passage with the inner space of the hollow piston and in which a sleeve is inserted which with a part of its wall forms an oil transfer channel between an oil inlet in the housing and an upper region of the reservoir.

10 Claims, 5 Drawing Sheets

HYDRAULIC PLAY COMPENSATION ELEMENT

STATE OF THE ART

Figure 1:
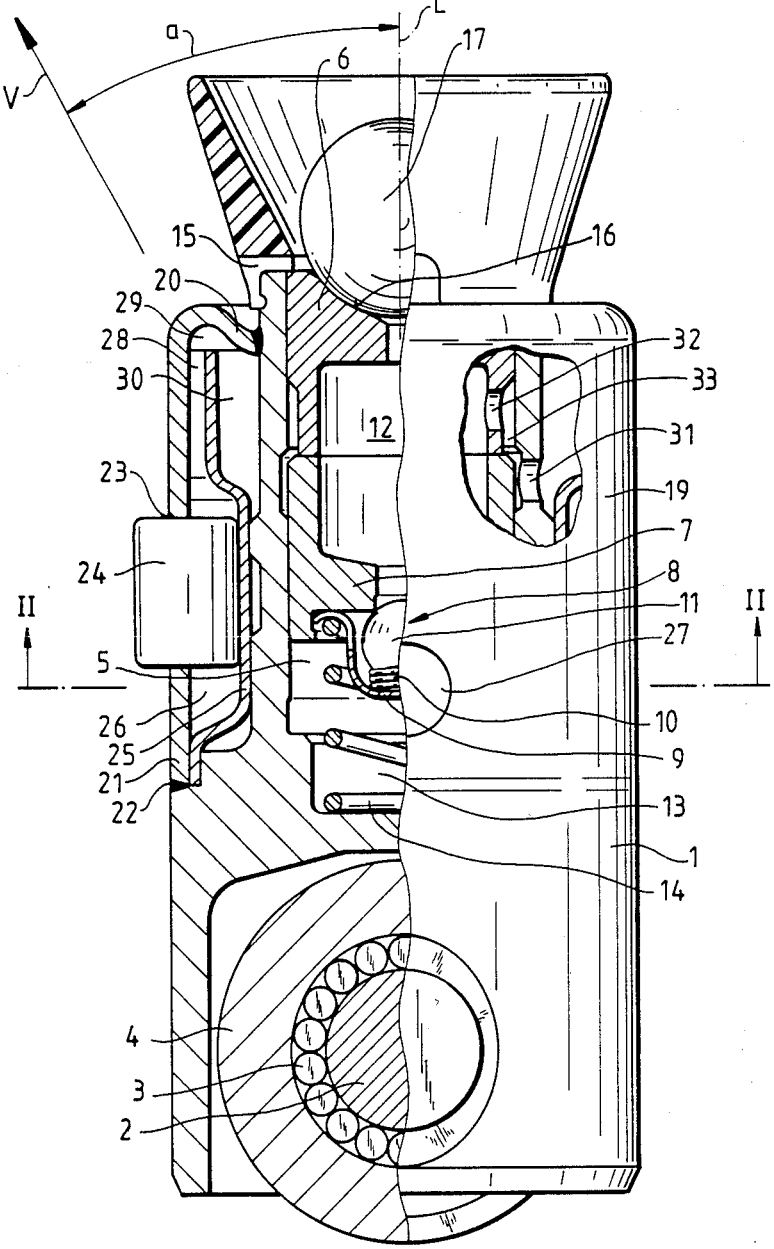

A play compensation element of this type is described in DE-OS 3,006,644 which is intended for an internal combustion engine with an overhead camshaft and which in operation, must be able to turn about its longitudinal axis. As a result of this, because of the slanting position of the longitudinal axis after assembly, the opening of the oil transfer channel can lie at a higher or lower level depending on the position of turn. When the opening is at a low level, the volume of oil retained in the oil reservoir by the oil transfer channel when there is no oil pressure at the oil inlet is substantially less than when the opening is at a higher level. It must be assured that even under unfavorable operation conditions, the oil level in the oil reservoir cannot sink so far that air can enter the inner space of the hollow piston through the oil passage.

In prior German patent application No. P 3,638,202, a play compensation element for an internal combustion engine with overhead valves is described. In a recess in the housing, an anti-torsion body is inserted and prevents the play compensation element in the engine block from turning about its longitudinal axis. The recess is situated in the oil reservoir and through this recess, oil can flow out. In particularly unfavorable operation modes of the engine, the oil reservoir can become emptied and air can enter the inner space of the hollow piston and this is undesirable.

OBJECTS OF THE INVENTION

It is an object of the invention to modify a play compensation element of the type initially described so that its housing is guided in the engine block so as not to be able to turn about its longitudinal axis and that the oil reserve in the oil reservoir is guaranteed.

This and other objects and advantages of the invention will become obvious from the following detailed description.

THE INVENTION

The hydraulic play compensation element of the invention for the drive of a valve of an internal combustion engine comprising a housing in which a hollow piston is mounted so as to be acted upon by oil pressure via a non-return valve, the hollow piston being surrounded by an oil reservoir which communicates via an oil passage with the inner space of the hollow piston and in which a sleeve is inserted which forms with a part of its wall an oil transfer channel betwen an oil inlet in the housing and an upper region of the reservoir is characterized in that the sleeve has a shaped section in which an anti-torsion body is propped which is inserted in a recess of the housing, the sleeve covers the oil reservoir against the recess and the oil transfer channel opens into the oil reservoir at a first circumferential point which is located higher than other circumferential points in the torsion-proof assembled position of the play compensation element when the longitudinal axis (L) is in a slanting position.

The sleeve serves no only to provide the oil transfer channel but also to arrange the anti-torsion body in such a manner that no oil can flow out of the reservoir through the recess in any case. Because the anti-torsion body prevents turning of the housing about the longitudinal axis and the opening of the oil transfer channel is situated at a high point with regard to the slanting position of the longitudinal axis after assembly, it is guaranteed that the oil reservoir remains filled with oil, even when the oil transfer channel gets emptied through the oil inlet.

In a preferred embodiment of the invention, the oil passage opens into the reservoir at a second circumferential point of the oil reservoir which is offset 180° from the first circumferential point which results in the oil passage being located at a lower level than the opening. Thus, a substantial part of the oil volume in the oil reservoir is available for the inner space of the hollow piston and can therefore be accordingly small, which fact permits a compact design of the play compensation element.

In another preferred embodiment of the invention, the sleeve is shaped to form an annular channel which is open to the oil inlet and which leads to the oil reservoir only through the oil transfer channel. This annular channel serves not only to receive and cover the anti-torsion body but also to transfer oil from the oil inlet to the oil transfer channel whereby the oil inlet can be located at a circumferential point of the housing offset with respect to the oil transfer channel.

It is also possible to provide, in front of the oil passage, a further channel which opens into the oil reservoir at a point situated as low as possible. By this, the oil volume of the oil reservoir is even more completely available for the inner space of the hollow piston.

Referring now to the drawings

Figure 2:
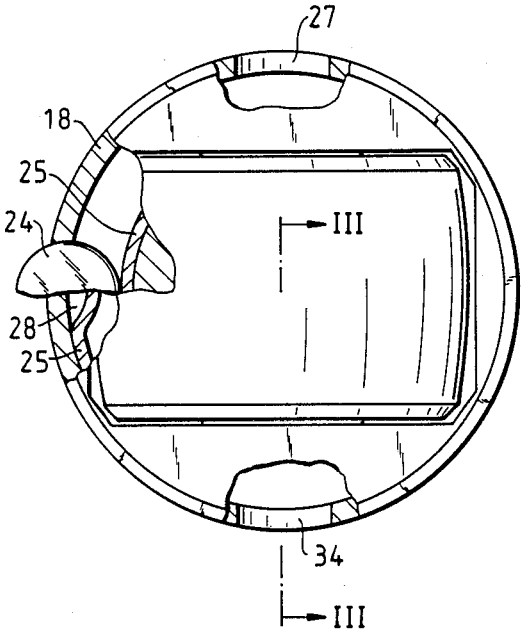
Figure 3:
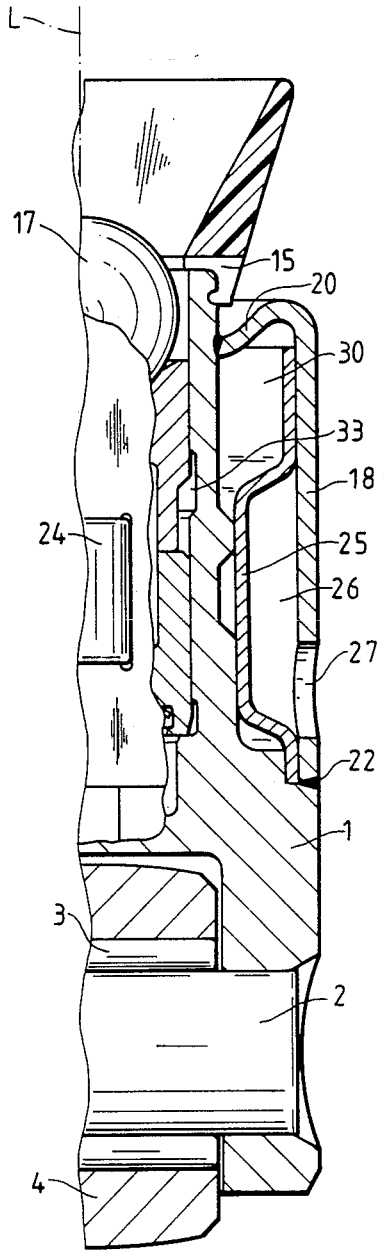

FIG. 1 is a partial longitudinal cross-section of a hydraulic play compensation element in the form of a roller tappet, FIG. 2 is a section along the line II—II of FIG. 1 and FIG. 3 is a partial section along the line III—III of FIG. 2.

Figure 4:
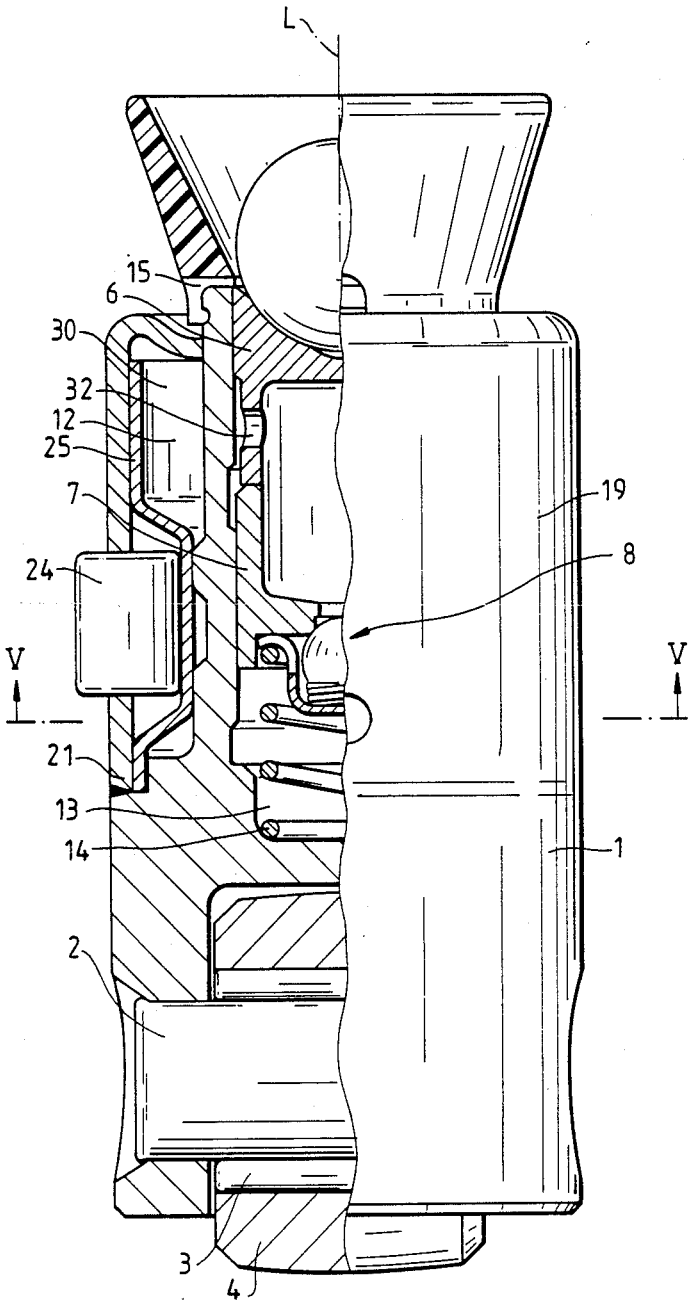
Figure 5:
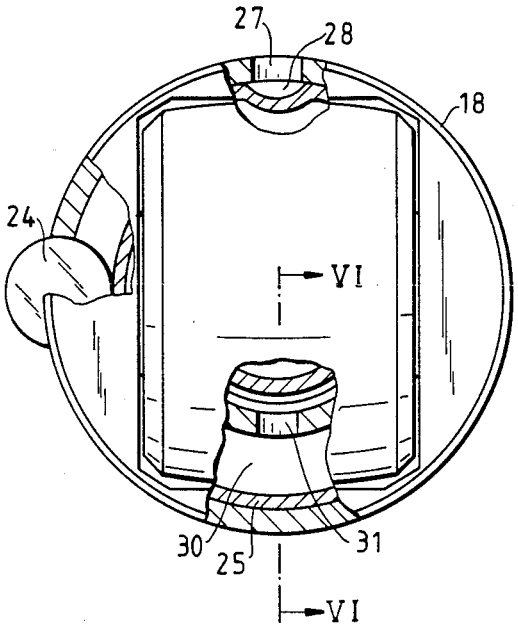
Figure 6:
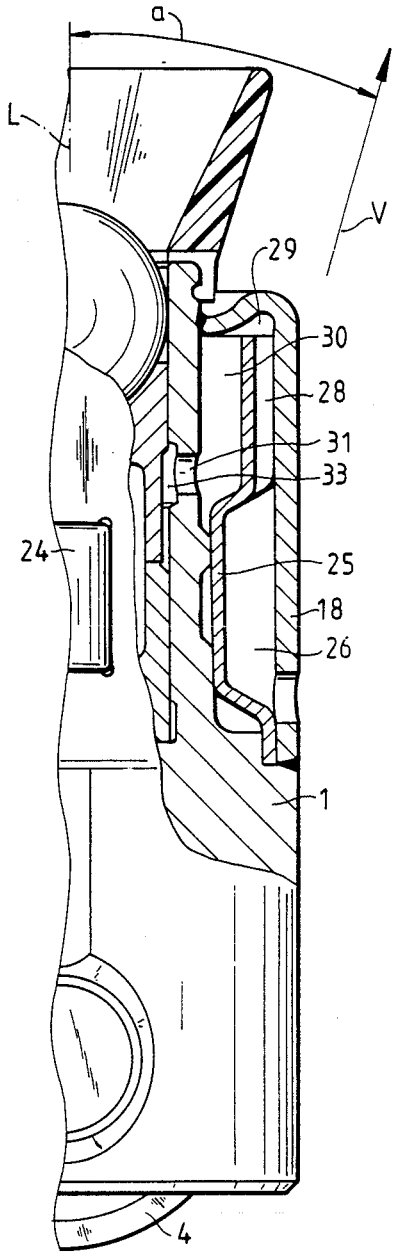
Figure 7:
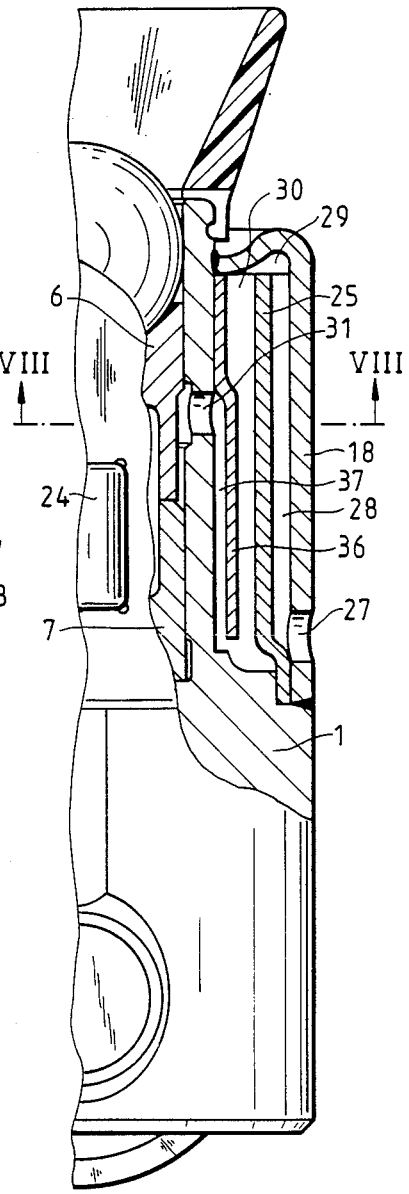
Figure 8:
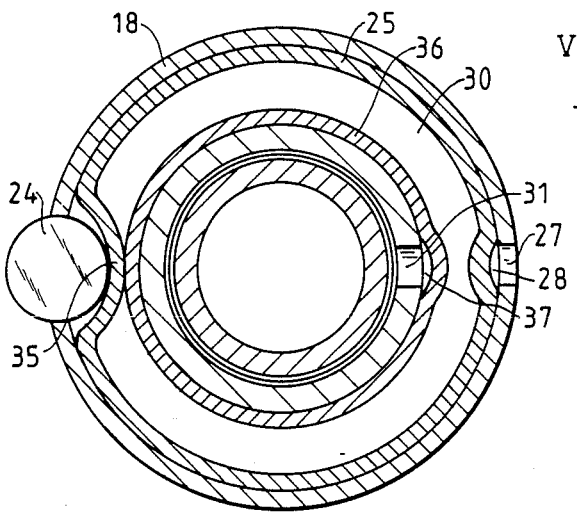

FIG. 4 is a partial longitudinal cross-section of another embodiment of a roller tappet, FIG. 5 is a section along the line V—V of FIG. 4 and FIG. 6 is a partial section along the line VI—VI of FIG. 5 showing the oil passage bore offset by 180° around the circumference, FIG. 7 is a view corresponding to that of FIG. 6 of a further embodiment and FIG. 8 is a section along the line VIII—VIII of FIG. 7.

In FIG. 1, the roller tappet has a housing (1) on which a pin (2) is fixed and a roller (4) is mounted on the pin (2) by means of needle rollers (3). In a recess (5) of the housing (1), a two-part lifting piston (6,7) is movably mounted. At the lower part (7) of the piston, a non-return valve (8) comprising a valve flap (9), a pressure spring (10) and a valve ball (11) is arranged. The non-return valve (8) establishes a connection between an inner space (12) of the hollow piston (6,7) and a pressure chamber (13) lying within the housing (1) behind the hollow piston (6,7). In the pressure chamber (13), a pressure spring (14) is arranged which acts on the lower part (7) of the piston and presses the upper part (6) of the piston against a retainer cap (15) fixed to the housing (1). The upper part (6) has a concave receiving surface (16) for a pressure ball (17).

An annular member (18) is placed around the housing (1) in the region of the hollow piston (6,7) and has a ground outer surface (19). One end of the annular member (18) is provided with a neck (20) which is welded to the housing (1) and the other end (21) of the annular 'member (18) is supported on a step (22) formed in the housing (1). This too, can be welded to the housing (1). The annular member (18) is provided with a recess (23) in which an anti-torsion body (24) is inserted. This is a needle roller which has no rolling function but serves as a guiding body in case of axial displacement of the roller tappet in the direction of the longitudinal axial (L) and also serves to prevent a turning movement about the longitudinal axis (L).

Within the annular member (18), a sleeve (25) is arranged around the housing (1) in the region of the hollow section (5) of the latter. The end of the sleeve (25) lying next to the step (22) is fixed tight to the housing (1) and the annular member (18). The sleeve (25) forms an annular channel (26) which is open to an oil inlet (27) provided in the annular member (18). In the region of the annular channel (26), the anti-torsion body (24) is propped against the sleeve (25). The parts of the sleeve (25) continuing from the annular channel (26) lie in a close fit against the annular member (18) with the exception that at one circumferential point of the sleeve (25), an oil transfer channel (28) is formed by a corresponding crease in the sleeve (25). The oil transfer channel (28) communicates via an opening (29) with an oil reservoir (30) lying within the sleeve (25) and extending around the housing (1).

The oil reservoir (30) is connected via an oil passage (31, 32, 33) with the inner space (12) of the hollow piston (6,7). For the oil passage, one oil passage bore (31) is provided in the housing (1) and another oil passage bore (32) is provided in the hollow piston (6,7). Between the two oil passage bores (31,32) and connecting them with one another is an annular slot (33)

In FIGS. 1 to 6, the vertical direction (V) is shown. When the roller tappet is mounted in the engine block, the longitudinal axis (L) of the roller tappet is at an acute angle (a) to the vertical (V). Against the lower part of the roller (4), the cam of a camshaft, not shown in the figures, abuts and the pressure ball (17) acts on a control rod, not shown, of a valve of the engine.

The embodiment of the invention of FIGS. 1 to 8 is meant for an assembling position in which the anti-torsion body (24) is located at a circumferential point of a surface plane running radial and perpendicular to the longitudinal axis (L). This circumferential point lies, with respect to the vertical (V), higher than all other circumferential points of this surface plane. The oil transfer channel (28) is located next to the anti-torsion body (24) and its opening therefore, with respect to the vertical (V), lies higher than all other circumferential points located on a surface plane running radial and perpendicular to the longitudinal axis (L). The oil transfer channel (28) thus opens into the oil reservoir (30) at the highest point of this latter in the assembled position.

The oil inlet (27) is offset with respect to the anti-torsion body (24) by 90° around the periphery of the annular member (18). Offset by 180° with respect to the oil inlet (27), another oil aperture (34) communicating with the annular channel (26) is provided in the annular member (18). The annular channel (26) by-passes the oil reservoir (30) and establishes a connection between the oil inlet (27) and the oil aperture (34). Through the oil aperture (34), oil in the engine block is conveyed to a further roller tappet.

With respect to the anti-torsion body (24) and the opening (29), the oil passage bore (31) is offset around the periphery of the housing (1) by 180°. In the assembled position therefore, it lies, with respect to the vertical (V), at the lowest point of a surface plane which traverses it and runs perpendicular and radical to the longitudinal axis (L).

Oil entering through the oil inlet (27) reaches the oil transfer channel (28) through the annular channel (26) and enters the oil reservoir (30) through the opening (29). After traversing the oil passage (31, 32, 33), it reaches the inner space (12) and from there via the non-return valve (8), the pressure chamber (13). During an eventual emptying out of the annular channel (26), the oil remains in the oil reservoir (30) so that even in particular operational situations, no air can penetrate into the inner space (12) and from there into the pressure chamber (13). Since the opening (29) is located at the highest and the oil passage (31) at a very low point of the oil reservoir (30), essentially the entire oil volume of the oil reservoir (30) is available for refilling the inner space (12).

In the embodiment of the invention of FIGS. 4 to 6, the oil inlet (27) lies, with respect to the vertical (V), at the highest circumferential point of a plane which traverses it and runs radial and perpendicular to the longitudinal axis (L). Accordingly, the oil transfer channel (28) is directly connected with the oil inlet (27) in this case. The oil passage bore (31) is offset on the periphery by 180° with respect to the oil transfer channel (28) (cf. FIG. 5—in FIG. 6, to simplify the drawing, the oil passage bore (31) is represented at a point which is offset by 180° from its actual position). Therefore, even in this case, the opening (29) is located at the highest and the oil passage bore (31) at a very low point of the oil reservoir (30). The anti-torsion body (24) is offset by 90° on the periphery of the annular member (18) with respect to the oil inlet (27).

In the embodiment of the invention of FIGS. 7 and 8, a shaped section (35) of the sleeve (25) supports the anti-torsion body (24) in a crease. The oil transfer channel (28) lies next to the oil inlet (27) and is also formed by a crease in the sleeve (25). The oil transfer channel (28) is offset on the periphery of the sleeve (25) by 180° with respect to the shaped section (35).

Another sleeve (36) is placed around the housing (1) and forms a further oil transfer channel (37) which lies in front of the oil passage bore (31) and at it lower end opens into the oil reservoir (30). This design permits that essentially, the entire space between the annular member (18) and the housing (1) is used as oil reservoir (30). The other oil transfer channel (37) assures that the oil passage bore (31) is connected with as low a point of the oil reservoir (30) as possible. For construction reasons, it is not possible to place the oil passage bore (31) itself in the region of the opening of the other oil transfer channel (37).

Various modifications of the play compensation element of the invention may be made without departing from the spirit or scope thereof and it is to be understood that the invention is intended to be limited only as defined in the appended claims.

What we claim is:

1. A hydraulic play compensation element for the drive of a valve of an internal combustion engine comprising a housing in which a hollow piston is mounted so as to be acted upon by oil pressure via a non-return valve, the hollow piston being surrounded by an oil reservoir which communicates via an oil passage with the inner space of the hollow piston and in which a sleeve is inserted which forms with a part of its wall an oil transfer channel between an oil inlet in the housing and an upper region of the reservoir, characterized in that the sleeve has a shaped section in which an anti-torsion body is propped which is inserted in a recess of the housing, the sleeve covers the oil reservoir against the recess and the oil transfer channel opens into the oil reservoir at a first circumferential point which is located higher than other circumferential points in the torsion-proof assembled position of the play compensation element when the longitudinal axis (L) is in a slanting position.

2. A hydraulic play compensation element of claim 1 wherein the oil passage opens into the reservoir at a second circumferential point of the oil reservoir which is offset at about 180° from the first circumferential point.

3. A hydraulic play compensation element of claim 1 wherein a further oil transfer channel is formed in front of the oil passage and opens into the oil reservoir at a point situated as low as possible.

4. A hydraulic play compensation element of claim 3 wherein the other oil transfer channel is formed by another sleeve.

5. A hydraulic play compensation element of claim 1 wherein the shaped section of the sleeve forms an annular channel which is open to the oil inlet and which communicates with the oil reservoir only through the oil transfer channel.

6. A hydraulic play compensation element of claim 1 wherein the oil transfer channel lies next to the anti-torsion body.

7. A hydraulic play compensation element of claim 5 wherein the annular channel leads to another oil aperture of the housing lying diametrically opposed to the oil inlet.

8. A hydraulic play compensation element of claim 6 wherein the annular channel leads to another oil aperture of the housing lying diametrically opposed to the oil inlet.

9. A hydraulic play compensation element of claim 1 wherein the oil transfer channel lies next to the oil inlet.

10. A hydraulic play compensation element of claim 2 wherein a further oil transfer channel is formed in front of the oil passage and opens into the oil reservoir at a point situated as low as possible.

* * * * *